US011795826B2

(12) United States Patent
Calixtro et al.

(10) Patent No.: US 11,795,826 B2
(45) Date of Patent: Oct. 24, 2023

(54) TURBINE BLADE NECK POCKET

(71) Applicant: Raytheon Technologies Corporation, Farmington, CT (US)

(72) Inventors: Carlos Calixtro, Atlanta, GA (US); Stephen D. Doll, Ponte Vedra, FL (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/651,174

(22) Filed: Feb. 15, 2022

(65) Prior Publication Data

US 2023/0258089 A1 Aug. 17, 2023

(51) Int. Cl.
*F01D 5/14* (2006.01)

(52) U.S. Cl.
CPC ..... *F01D 5/147* (2013.01); *F05D 2220/323* (2013.01); *F05D 2240/30* (2013.01)

(58) Field of Classification Search
CPC ..... F01D 5/22; F01D 11/006; F01D 5/3007; F01D 11/008; F01D 5/147; F01D 5/26; F01D 5/12; F01D 5/141; F01D 5/30; F01D 5/02; F01D 5/081; F01D 5/10; F01D 5/16; F01D 5/3015; F01D 5/3023; F01D 5/303; F01D 5/326; F01D 5/34; F05D 2240/80; F05D 2240/30; F05D 2260/96; F05D 2260/30; F05D 2240/55; F05D 2260/941; F05D 2220/30; F05D 2220/32; F05D 2220/323; F05D 2240/57; F04D 29/083

See application file for complete search history.

(56) References Cited

U.S. PATENT DOCUMENTS

| | | | | |
|---|---|---|---|---|
| 5,924,699 | A * | 7/1999 | Airey | F01D 11/006 277/411 |
| 8,137,072 | B2 | 3/2012 | Kim et al. | |
| 9,140,132 | B2 | 9/2015 | Faulder et al. | |
| 9,638,049 | B2 * | 5/2017 | Dupeyre | F01D 11/006 |
| 9,932,834 | B2 | 4/2018 | Hough et al. | |

* cited by examiner

*Primary Examiner* — Eric J Zamora Alvarez
(74) *Attorney, Agent, or Firm* — Kinney & Lange, P.A.

(57) ABSTRACT

A turbine blade for use in a gas turbine engine includes localized thickening of a neck pocket of the turbine blade to meet strength requirements while minimizing the weight of the turbine blade. More specifically, a convex spline is positioned within a suction side neck pocket of the turbine blade adjacent a leading edge of the neck pocket to increase the strength of the blade.

13 Claims, 4 Drawing Sheets

TURBINE BLADE NECK POCKET

BACKGROUND

The present invention relates to turbine blades for use in gas turbine engines and, more particularly, to localized thickening of a neck pocket of the turbine blade.

A gas turbine engine typically includes a fan section, a compressor section, a combustor section, and a turbine section. Air entering the compressor section is compressed and delivered into the combustion section where it is mixed with fuel and ignited to generate a high-energy gas flow. The high-energy gas flow expands through the turbine section to drive the compressor and the fan section. The compressor section typically includes low-pressure and high-pressure compressors, and the turbine section typically includes low-pressure and high-pressure turbines. Both the compressor and turbine sections include rotating blades alternating between stationary vanes. The rotating blades in the turbine section experience high-levels of stress during operation of the gas turbine engine. As such, the rotating blades must have adequate strength properties to manage the stresses while also minimizing the weight of the rotating blades to achieve efficient turbine blades and an efficient gas turbine engine.

SUMMARY

According to one aspect of the disclosure, a turbine blade for use in a gas turbine engine is disclosed. The turbine blade includes a platform, an airfoil extending radially outward from the platform, a root extending radially inward from the platform, and a neck pocket positioned between the platform and the root. The airfoil includes a pressure-side sidewall and a suction-side sidewall extending spanwise between the platform and a blade tip, and chordwise between a leading edge and a trailing edge of the airfoil. The neck pocket includes a convex spline extending towards a trailing edge of the neck pocket such that the convex spline extends to between 30% and 60% a distance from a front surface of the root to a rear surface of the root.

According to another aspect of the disclosure, a turbine blade for use in a gas turbine engine is disclosed. The turbine blade includes a platform, an airfoil extending radially outward from the platform, a root extending radially inward from the platform, and a neck pocket positioned between the platform and the root. The airfoil includes a pressure-side sidewall and a suction-side sidewall extending spanwise between the platform and a blade tip, and chordwise between a leading edge and a trailing edge of the airfoil. The neck pocket includes a first concave portion, a second concave portion, and a convex spline extending between the first concave portion and the second concave portion.

DETAILED DESCRIPTION

Figure 1:
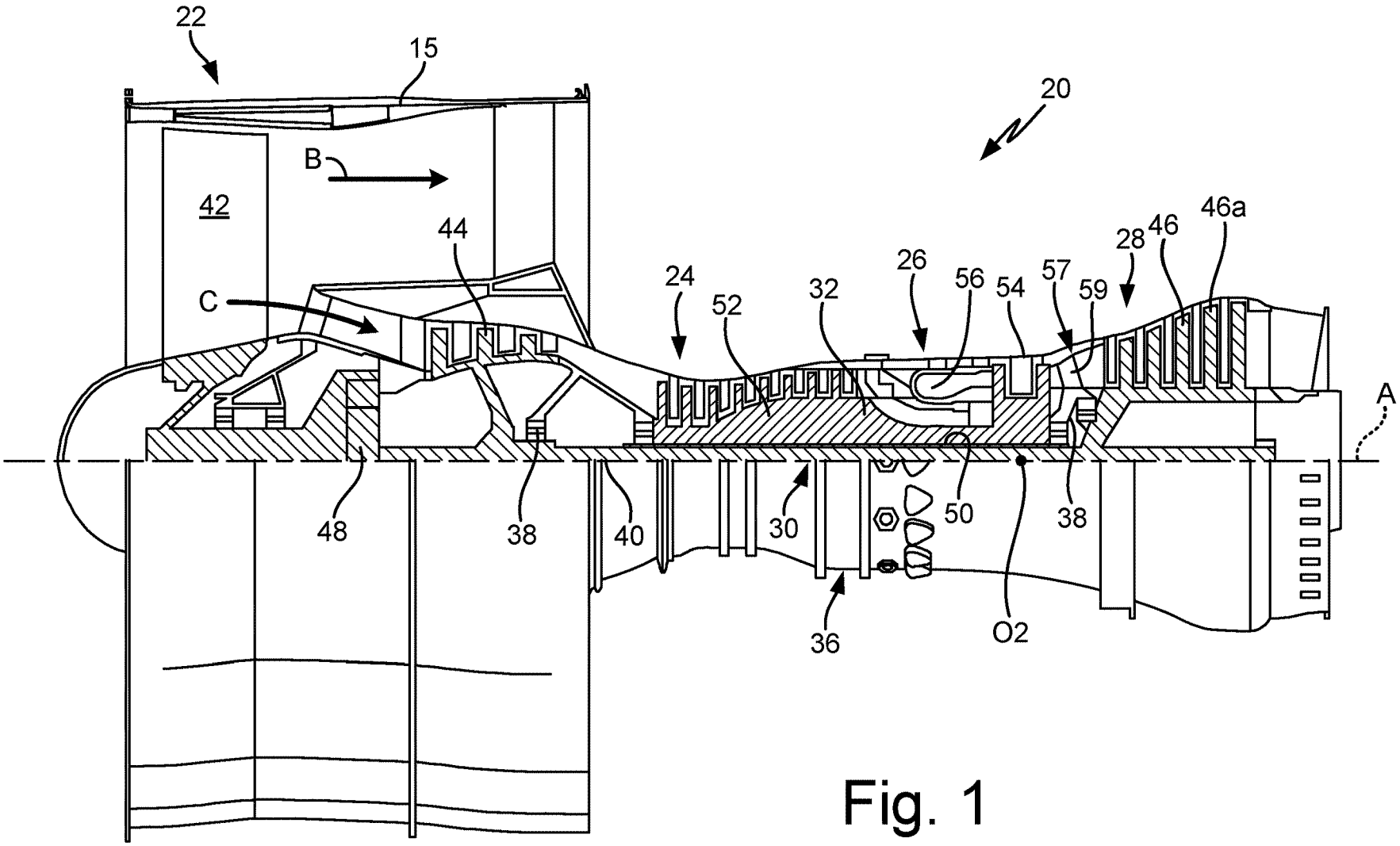
FIG. 1 is an axial cross-sectional view of an exemplary gas turbine engine.
Figure 3:
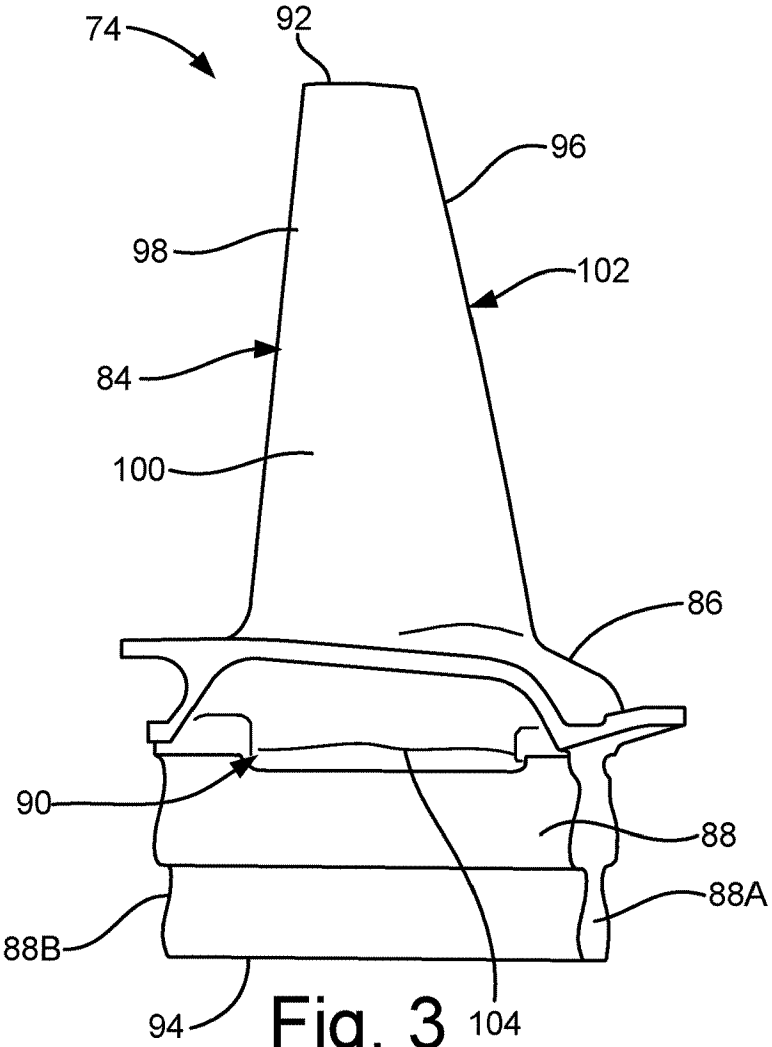
FIG. 3 is a perspective view of a turbine blade used within the gas turbine engine.
Figure 2:
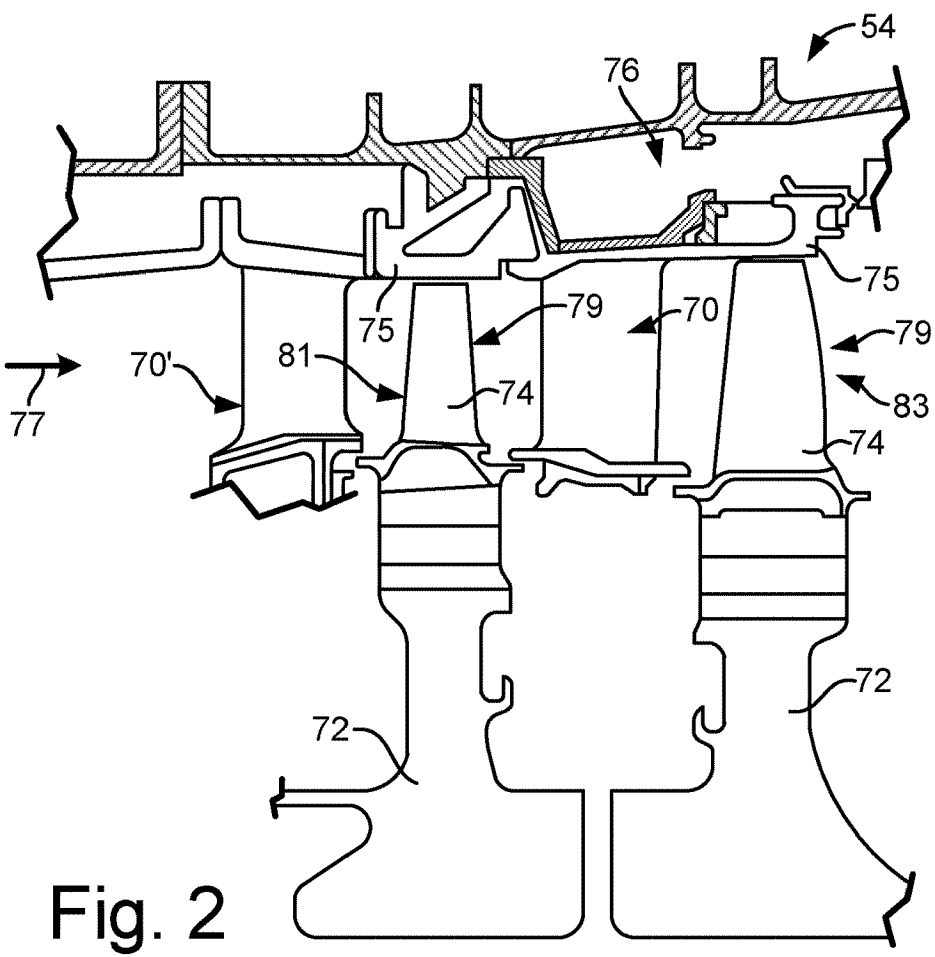
FIG. 2 is a schematic view of a two-stage high pressure turbine of the gas turbine engine.

FIG. 1 is an axial cross-sectional view of an exemplary gas turbine engine 20. FIG. 2 is a schematic view of a two-stage high pressure turbine of gas turbine engine 20. FIG. 3 is a perspective view of a turbine blade used within gas turbine engine 20. FIGS. 1-3 will be discussed together. Gas turbine engine 20 is disclosed herein as a two-spool turbofan that generally incorporates a fan section 22, a compressor section 24, a combustor section 26, and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low-speed spool 30 and a high-speed spool 32 mounted for rotation about an engine central longitudinal axis A (engine centerline) relative to an engine static structure 36 via several bearing systems 38. It should be understood that various bearing systems 38 at various locations may alternatively or additionally be provided, and the location of bearing systems 38 may be varied as appropriate to the application.

The low-speed spool 30 generally includes an inner shaft 40 that interconnects a fan 42, a first or low-pressure compressor 44 and a first or low-pressure turbine 46. The inner shaft 40 is connected to the fan 42 through a speed change mechanism, which in exemplary gas turbine engine 20 is illustrated as a geared architecture 48 to drive the fan 42 at a lower speed than the low-speed spool 30. The high-speed spool 32 includes an outer shaft 50 that interconnects a second or high-pressure compressor 52 and a second or high-pressure turbine 54. A combustor 56 is arranged in exemplary gas turbine 20 between the high-pressure compressor 52 and the high-pressure turbine 54. A mid-turbine frame 57 of the engine static structure 36 is arranged generally between the high-pressure turbine 54 and the low-pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A (engine centerline) which is collinear with their longitudinal axes.

The core airflow is compressed by the low-pressure compressor 44 then the high-pressure compressor 52, mixed and burned with fuel in the combustor 56, then expanded over the high-pressure turbine 54 and low-pressure turbine 46. The mid-turbine frame 57 includes airfoils 59 which are in the core airflow path C. The turbines 46, 54 rotationally drive the respective low speed spool 30 and high-speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), and can be less than or equal to about 18.0, or more narrowly can be less than or equal to 16.0. The geared architecture 48 is an epicyclic gear train, such as a planetary gear system or other gear system, with a gear reduction ratio of greater than about 2.3. The gear reduction ratio may be less than or equal to 4.0. The low pressure turbine 46 has a pressure ratio that is greater than about five. The low pressure turbine pressure ratio can be less than or equal to 13.0, or more narrowly less than or equal to 12.0. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to an inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above and those in this paragraph are measured at this condition unless otherwise specified. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45, or more narrowly greater than or equal to 1.25. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150.0 ft/second (350.5 meters/second), and can be greater than or equal to 1000.0 ft/second (304.8 meters/second).

FIG. 2 illustrates a portion of the high-pressure turbine (HPT) 54. FIG. 2 also illustrates high-pressure turbine stage vanes 70 one of which (e.g., first stage vane 70') is located forward of a first one of a pair of turbine disks 72 each having a plurality of turbine blades 74 secured thereto. Turbine blades 74 rotate proximate blade outer air seals (BOAS) 75 which are located aft of vane 70 or first stage vane 70'. The other vane 70 is located between the pair of turbine disks 72, this vane 70 may be referred to as the second stage vane. As used herein first stage vane 70' is the first vane of high-pressure turbine section 54 that is located aft of combustor section 26 and second stage vane 70 is located aft of first stage vane 70' and is located between the pair of turbine disks 72. In addition, blade outer air seals (BOAS) 75 are disposed between first stage vane 70' and second stage vane 70. The high-pressure turbine stage vane 70 (e.g., second stage vane) is one of a plurality of vanes 70 that are positioned circumferentially about the axis A (engine centerline) of the engine in order to provide stator assembly 76. Hot gases from combustor section 26 flow through the turbines in the direction of arrow 77. Although a two-stage high pressure turbine is illustrated, other high-pressure turbines are considered to be within the scope of various embodiments of the present disclosure.

As discussed, turbine blades 74 are secured to turbine disk 72 that is configured to rotate about axis A (engine centerline). Turbine disk 72 and its attached turbine blades 74 may be referred to as turbine rotor assembly 79. Turbine blades 74 and their associated disks 72 are located behind or downstream from first stage vane 70' and the second stage vane 70. The turbine blades located behind or downstream from first stage vane 70' and in front of second stage vane 70 may be referred to as first stage turbine blades 81. The turbine blades located behind or downstream from second stage vane 70 may be referred to as second stage turbine blades 83. The following discussion regarding turbine blade 74 should be understood to apply equally to both first stage turbine blades 81 and second stage turbine blade 83.

FIG. 3 is a perspective view of turbine blade 74 used within gas turbine engine 20. Turbine blade 74 includes airfoil 84, platform 86, root 88, and neck pocket 90. Airfoil 84 is coupled to platform 86 at one end and airfoil 84 includes blade tip 92 that terminates at the other end of airfoil 84, opposite platform 86. Airfoil 84 extends radially outward from platform 86, with respect to axis A (FIG. 1), such that blade tip 92 of airfoil 84 is at a further radial distance from axis A than platform 86. Root 88 is coupled to platform 86 and root 88 extends radially inward from platform 86, with respect to axis A, such that root 88 is at a closer radial distance to axis A than platform 86. Root 88 is used to secure turbine blade 74 to turbine disk 72. Root 88 includes base 94, which is the innermost surface of root 88 and turbine blade 74. In other words, base 94 is a surface of root 88 that is positioned closer to axis A than any other feature of turbine blade 74. In contrast, blade tip 92 of airfoil 84 is positioned farther from axis A than any other feature of turbine blade 74. Neck pocket 90 is positioned between platform 86 and root 88 on both sides of turbine blade 74. More specifically, neck pocket 90 extends inward into both sides of turbine blade 74, creating recesses within turbine blade 74 between platform 86 and root 88. As such, platform 86 overhangs neck pocket 90 on each side of turbine blade 74, such that platform 86 can mate and seal against an adjacent platform 86 of an adjacent turbine blade 74 within gas turbine engine 20. In one embodiment, airfoil 84 may be integrally formed or cast with platform 86, root 88, and/or neck pocket 90. In other words, turbine blade 74 including airfoil 84, platform 86, root 88, and neck pocket 90 may be cast as a single part.

Airfoil 84 includes leading edge 96, trailing edge 98, suction-side sidewall 100, and pressure-side sidewall 102. Leading edge 96 is the forward or upstream edge/surface of turbine blade 74, with respect to the flow direction through engine 20. Trailing edge 98 is the rear or downstream edge of turbine blade 74, with respect to the flow direction through engine 20. Suction-side sidewall 100 and pressure-side sidewall 102 each extend chordwise between leading edge 96 and trailing edge 98 and spanwise between platform 86 and blade tip 92. In some examples, airfoil 84 can include a plurality of cooling openings or film cooling holes that are in fluid communication with the internal cavities in order to provide a source of cooling fluid or air to portions of airfoil 84, such that film cooling can be provided at desired locations. Further, in the example shown, neck pocket 90 includes convex spline 104 positioned within neck pocket 90 on the suction-side sidewall 100 side of turbine blade 74, discussed further below.

Figure 4A:
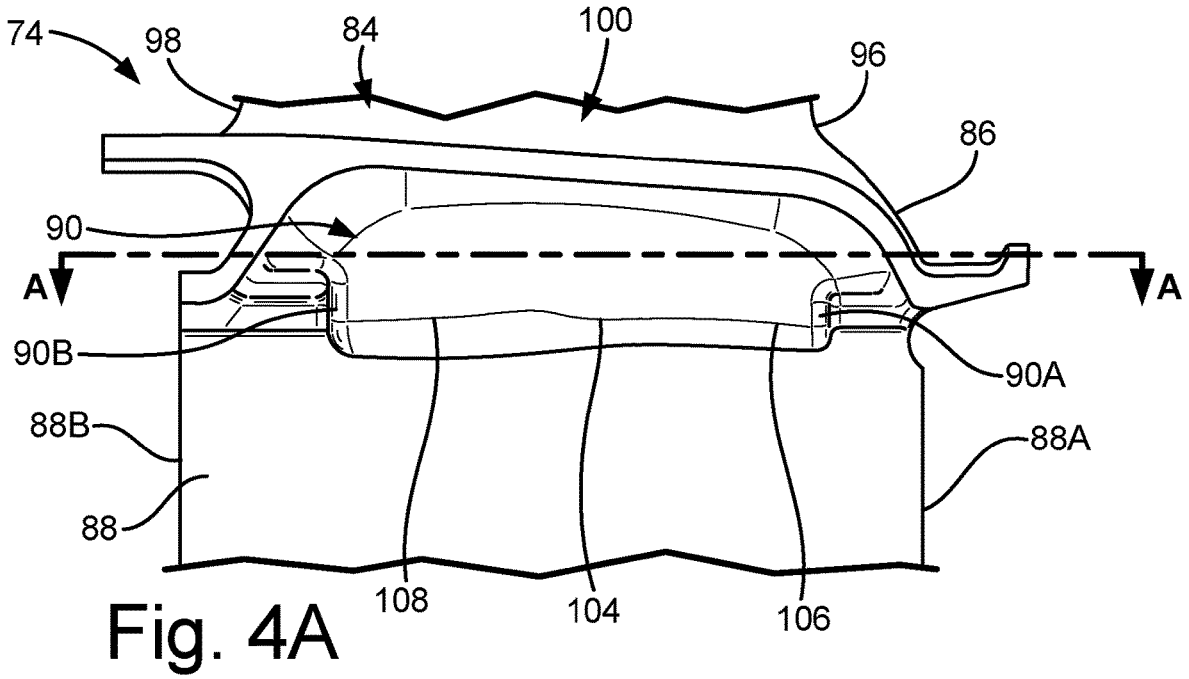
FIG. 4A is a closeup side view of a portion of the suction side of the turbine blade.
Figure 4B:
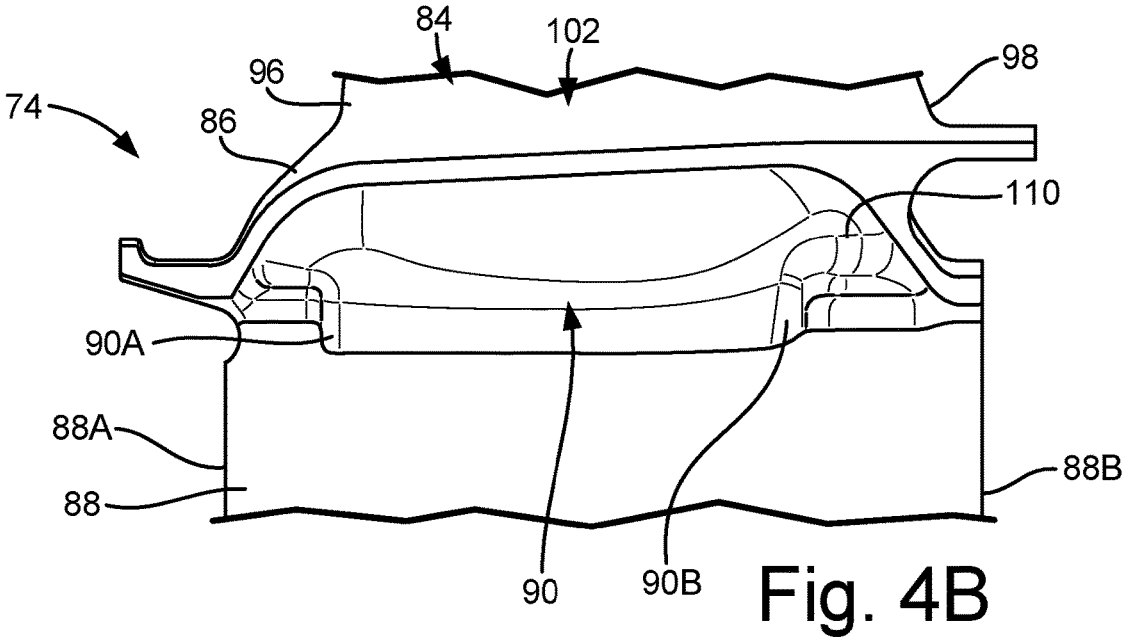
FIG. 4B is a closeup side view of a portion of the pressure side of the turbine blade.
Figure 4C:
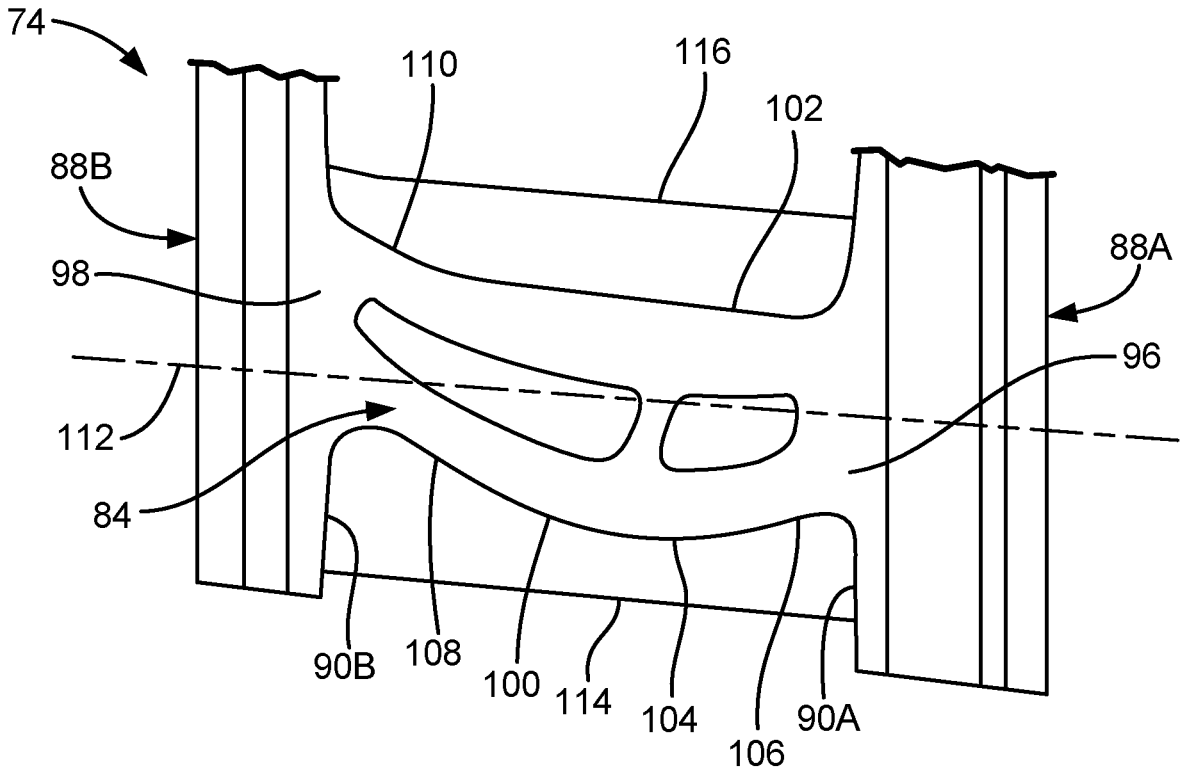
FIG. 4C is a top cross-sectional view of the turbine blade of FIG. 3.

FIG. 4A is a closeup side view of platform 86 and neck pocket 90 on the suction-side sidewall 100 side of turbine blade 74. FIG. 4B is a closeup side view of platform 86 and neck pocket 90 on the pressure-side sidewall 102 side of turbine blade 74. FIG. 4C is a top cross-sectional view taken through neck pocket 90 viewing downward toward root 88 of turbine blade 74. FIGS. 4A-4C will be discussed together. As shown in FIG. 4A, neck pocket 90 on the suction-side sidewall 100 side of turbine blade 74 includes first concave portion 106, second concave portion 108, and convex spline 104. First concave portion 106 and second concave portion 108 are surfaces of neck pocket 90 that curve or extend inward towards a center of platform 86 and turbine blade 74. Convex spline 104 is a surface of neck pocket 90 that curves or extends outward away from the center of platform 86 and turbine blade 74. First concave portion 106 is positioned at an upstream end of neck pocket 90, with respect to the flow direction through engine 20. Second concave portion 108 is positioned at a downstream end of neck pocket 90, with respect to the flow direction through engine 20. Convex spline 104 is positioned and extends between first concave portion 106 and second concave portion 108. Convex spline 104 merges via a variable blend into platform 86 and walls of neck pocket 90, creating a smooth transition between convex spline 104, walls of neck pocket 90, and platform 86. Further, convex spline 104 merges via a variable blend into first concave portion 106 and second concave portion 108, creating a smooth transition between convex spline 104, first concave portion 106, and second concave portion 108.

First concave portion 106 extends from leading edge 90A of neck pocket 90 towards trailing edge 90B of neck pocket 90. In some examples, first concave portion 106 extends from leading edge 90A to between 5% and 15% a distance from front surface 88A of root 88 to rear surface 88B of root 88. Convex spline 104 extends from an end of first concave portion 106 towards trailing edge 90B of neck pocket 90. In some examples, convex spline 104 extends from an end of first concave portion 106 to between 30% and 60% the distance from front surface 88A of root 88 to rear surface 88B of root 88. In other examples, convex spline 104 extends from an end of first concave portion 106 to between 40% and 50% the distance from front surface 88A of root 88 to rear surface 88B of root 88. Second concave portion 108 extends from an end of convex spline 104 to trailing edge 90B of neck pocket 90. As such, multiple sine wave changes occur within neck pocket 90 when extending from leading edge 90A of neck pocket 90 to trailing edge 90B of neck pocket 90. In other words, first concave portion 106 extends from leading edge 90A of neck pocket 90 a distance towards trailing edge 90B of neck pocket 90. Then first concave portion 106 transitions into convex spline 104, which extends a distance towards trailing edge 90B of neck pocket 90. Then convex spline 104 transitions into second concave portion 108, which extends to trailing edge 90B of neck pocket 90. Therefore, first concave portion 106, convex spline 104, and second concave portion 108 form a wavy surface extending from leading edge 90A to trailing edge 90B of neck pocket 90.

Referring now to FIG. 4B, neck pocket 90 on the pressure-side sidewall 102 side of turbine blade 74 includes concave spline 110. Concave spline 110 is a surface of neck pocket 90 that curves or extend inward towards a center of platform 86 and turbine blade 74. Concave spline 110 is positioned at a downstream end of neck pocket 90, with respect to the flow direction through engine 20. More specifically, concave spline 110 is positioned within neck pocket 90 on the pressure-side sidewall 102 side of turbine blade 74 and concave spline 110 extends from trailing edge 90B of neck pocket 90 towards leading edge 90A of neck pocket 90. In some examples, concave spline 110 extends to between 10% and 40% a distance from rear surface 88B of root 88 to front surface 88A of root 88. In other examples, concave spline 110 extends to between 20% and 30% a distance from rear surface 88B of root 88 toward front surface 88A of root 88. Concave spline 110 merges via a variable blend into platform 86 and walls of neck pocket 90, creating a smooth transition between concave spline 110, walls of neck pocket 90, and platform 86.

FIG. 4C is a cross-sectional view taken along Section A-A of FIG. 4A. Section A-A is an upper region of neck pocket 90 viewing downward toward root 88 of turbine blade 74. In the example shown, Section A-A is offset from base 94 of turbine blade 74 between 25% and 35% a distance from base 94 to tip 92 of turbine blade 74. As shown in FIG. 4C, central plane 112 is a plane extending through turbine blade 74 that is positioned an equal distance from first distal edge 114 and second distal edge 116 of root 88. First distal edge 114 of root 88 is the outermost edge of root 88 on the suction-side sidewall 100 side of turbine blade 74. First distal edge 114 extends generally in a direction from leading edge 96 of turbine blade 74 towards trailing edge 98 of turbine blade 74. Second distal edge 116 of root 88 is the outermost edge of root 88 on the pressure-side sidewall 102 side of turbine blade 74. Second distal edge 116 extends generally in a direction from leading edge 96 of turbine blade 74 towards trailing edge 98 of turbine blade 74. As such, first distal edge 114 and second distal edge 116 are positioned on opposite sides of central plane 112. Central plane 112 extends parallel to both first distal edge 114 and second distal edge 116, and therefore, central plane 112 extends from front surface 88A of root 88 to rear surface 88B of root 88. In some examples, central plane 112 can extend through front surface 88A and rear surface 88B of root 88.

As shown, first concave portion 106, second concave portion 108, and convex spline 104 are positioned within neck pocket 90 on the suction-side sidewall 100 side of turbine blade 74. The surface of neck pocket 90 is wavy and varies in thickness extending from leading edge 90A to trailing edge 90B of neck pocket 90, with respect to central plane 112. As such, a distance between central plane 112 and neck pocket 90 changes for each point along the surface of neck pocket 90. In one example, a minimum distance from central plane 112 to first concave portion 106 is between 5% and 15% a distance from base 94 to tip 92 of turbine blade 74. In another example, a maximum distance from central plane 112 to convex spline 104 is between 15% and 25% a distance from base 94 to tip 92 of turbine blade 74. In yet another example, a minimum distance from central plane 112 to second concave portion 108 is between 5% and 15% a distance from base 94 to tip 92 of turbine blade 74.

Varying the thickness of neck pocket 90 allows for optimization of neck pocket 90 and turbine blade 74 to reduce the weight of turbine blade 74 while maintaining sufficient strength properties to withstand the stresses experienced by turbine blade 74 during operation of gas turbine engine 20. Optimization of neck pocket 90 wall thicknesses includes increasing and decreasing the wall thickness of neck pocket 90 in targeted areas of neck pocket 90 (rather than the entire neck pocket) to manage stresses while reducing/minimizing the overall weight of turbine blade 74. This results in turbine blade 74 having less overall material and less overall weight, as compared to previous neck pocket configurations. Reducing the overall weight of turbine blade 74, while maintaining sufficient strength characteristics, results in an overall more efficient turbine blade 74, improving the operating performance and efficiency of gas turbine engine 20. As such, turbine blade 74 including localized thickening of neck pocket 90 is advantageous over previous thick walled neck pockets of previous turbine blades.

Discussion of Possible Embodiments

The following are non-exclusive descriptions of possible embodiments of the present invention.

A turbine blade for use in a gas turbine engine, the turbine blade comprising: a platform, an airfoil extending radially outward from the platform, a root extending radially inward from the platform, and a neck pocket positioned between the platform and the root; wherein the airfoil comprises a pressure-side sidewall and a suction-side sidewall extending spanwise between the platform and a blade tip, and chordwise between a leading edge and a trailing edge of the airfoil; and wherein the neck pocket comprises a convex spline extending towards a trailing edge of the neck pocket such that the convex spline extends to between 30% and 60% a distance from a front surface of the root to a rear surface of the root.

The turbine blade of the preceding paragraph can optionally include, additionally and/or alternatively, any one or more of the following features, configurations and/or additional components:

The convex spline is positioned within the neck pocket on the suction-side sidewall side of the turbine blade.

The convex spline extends to between 40% and 50% the distance from the front surface of the root to the rear surface of the root.

The convex spline merges via a variable blend into the platform and a neck pocket wall, creating a smooth transition between the convex spline, the neck pocket wall, and the platform.

A concave spline extending from a trailing edge of the neck pocket towards a leading edge of the neck pocket such that the concave spline extends to between 10% and 40% a distance from a rear surface of the root to a front surface of the root.

The concave spline is positioned within the neck pocket on the pressure-side sidewall side of the turbine blade.

The concave spline extends to between 20% and 30% the distance from the rear surface of the root to the front surface of the root.

The concave spline merges via a variable blend into the platform and a neck pocket wall, creating a smooth transition between the convex spline, the neck pocket wall, and the platform.

The neck pocket extends inward into both sides of the turbine blade, creating recesses within the turbine blade between the platform and the root, such that the platform overhangs the neck pocket on each side of the turbine blade; and the platform is configured to mate and seal against an adjacent platform of an adjacent turbine blade within the gas turbine engine.

The concave spline is positioned within the neck pocket on the pressure-side sidewall side of the turbine blade and the concave spline merges via a variable blend into the platform and a neck pocket wall, creating a smooth transition between the convex spline, the neck pocket wall, and the platform.

The following are further non-exclusive descriptions of possible embodiments of the present invention.

A turbine blade for use in a gas turbine engine, the turbine blade comprising: a platform, an airfoil extending radially outward from the platform, a root extending radially inward from the platform, and a neck pocket positioned between the platform and the root; wherein the airfoil comprises a pressure-side sidewall and a suction-side sidewall extending spanwise between the platform and a blade tip, and chordwise between a leading edge and a trailing edge of the airfoil; and wherein the neck pocket comprises a first concave portion, a second concave portion, and a convex spline extending between the first concave portion and the second concave portion.

The turbine blade of the preceding paragraph can optionally include, additionally and/or alternatively, any one or more of the following features, configurations and/or additional components:

The convex spline is positioned within the neck pocket on the suction-side sidewall side of the turbine blade.

The first concave portion extends from a leading edge of the neck pocket towards a trailing edge of the neck pocket such that the first concave portion extends to between 5% and 15% a distance from a front surface of the root to a rear surface of the root.

The convex spline extends from an end of the first concave portion towards the trailing edge of the neck pocket to between 40% and 50% the distance from the front surface of the root to the rear surface of the root.

The second concave portion extends from an end of the convex spline to the trailing edge of the neck pocket.

A central plane is positioned an equal distance from a first distal edge of the root and a second distal edge of the root; the central plane extends from a front surface of the root to a rear surface of the root; and a minimum distance from the central plane to the first concave portion is between 5% and 15% a distance from a base of the turbine blade to a tip of the turbine blade.

A central plane is positioned an equal distance from a first distal edge of the root and a second distal edge of the root; the central plane extends from a front surface of the root to a rear surface of the root; and a maximum distance from the central plane to the convex spline is between 15% and 25% a distance from a base of the turbine blade to a tip of the turbine blade.

A central plane is positioned an equal distance from a first distal edge of the root and a second distal edge of the root; the central plane extends from a front surface of the root to a rear surface of the root; and a minimum distance from the central plane to the second concave portion is between 5% and 15% a distance from a base of the turbine blade to a tip of the turbine blade.

A concave spline is positioned within the neck pocket on the pressure-side sidewall side of the turbine blade, and wherein the concave spline extends from a leading edge of the neck pocket to a trailing edge of the neck pocket.

The neck pocket extends inward into both sides of the turbine blade, creating recesses within the turbine blade between the platform and the root, such that the platform overhangs the neck pocket on each side of the turbine blade; and the platform is configured to mate and seal against an adjacent platform of an adjacent turbine blade within the gas turbine engine.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine blade for use in a gas turbine engine, the turbine blade comprising:

a platform;

an airfoil extending radially outward from the platform, wherein the airfoil comprises a pressure-side sidewall and a suction-side sidewall extending spanwise between the platform and a blade tip, and chordwise between a leading edge and a trailing edge of the airfoil;

a root extending radially inward from the platform; and a suction-side neck pocket positioned between the platform and the root on the suction-side sidewall side of the turbine blade;

wherein the suction-side neck pocket comprises:

a first concave portion extending inward towards a center of the platform and the turbine blade, wherein the first concave portion is positioned at an upstream end of the suction-side neck pocket with respect to a flow direction through the gas turbine engine;

a second concave portion extending inward towards the center of the platform and the turbine blade, wherein the second concave portion is positioned at a downstream end of the suction-side neck pocket with respect to the flow direction through the gas turbine engine; and a convex spline positioned within the suction-side neck pocket and extends between the first concave portion and the second concave portion, wherein the convex spline extends outward away from the center of the platform and the turbine blade and wherein the convex spline extends towards a trailing edge of the suction-side neck pocket such that the convex spline extends to between 30% and 60% a distance from a front surface of the root to a rear surface of the root.

2. The turbine blade of claim 1, wherein the convex spline extends to between 40% and 50% the distance from the front surface of the root to the rear surface of the root.

3. The turbine blade of claim 1, wherein the convex spline merges via a variable blend into the platform and a suction-side neck pocket wall, creating a smooth transition between the convex spline, the suction-side neck pocket wall, and the platform.

4. The turbine blade of claim 1, further comprising:

a pressure-side neck pocket positioned between the platform and the root on the pressure-side sidewall side of the turbine blade;

wherein the pressure-side neck pocket comprises a concave spline extending from a trailing edge of the pressure-side neck pocket towards a leading edge of the pressure-side neck pocket such that the concave spline extends to between 10% and 40% a distance from the rear surface of the root to the front surface of the root.

5. The turbine blade of claim 4, wherein the concave spline extends to between 20% and 30% the distance from the rear surface of the root to the front surface of the root.

6. The turbine blade of claim 4, wherein the concave spline merges via a variable blend into the platform and a pressure-side neck pocket wall, creating a smooth transition between the concave spline, the pressure-side neck pocket wall, and the platform.

7. The turbine blade of claim 4, wherein:

the suction-side neck pocket and the pressure-side neck pocket both extend inward into the suction side and pressure side of the turbine blade, respectively, creating recesses within the turbine blade between the platform and the root, such that the platform overhangs the suction-side neck pocket and the pressure-side neck pocket on each side of the turbine blade; and the platform is configured to mate and seal against an adjacent platform of an adjacent turbine blade within the gas turbine engine.

8. The turbine blade of claim 4, wherein the concave spline is positioned within the neck pocket on the pressure-side sidewall side of the turbine blade and the concave spline merges via a variable blend into the platform and a neck pocket wall, creating a smooth transition between the concave spline, the neck pocket wall, and the platform.

9. The turbine blade of claim 1, wherein the first concave portion extends from a leading edge of the suction-side neck pocket towards the trailing edge of the suction-side neck pocket such that the first concave portion extends to between 5% and 15% a distance from the front surface of the root to the rear surface of the root.

10. The turbine blade of claim 9, wherein the second concave portion extends from an end of the convex spline to the trailing edge of the neck pocket.

11. The turbine blade of claim 1, wherein:

a central plane is positioned an equal distance from a first distal edge of the root and a second distal edge of the root;

the central plane extends from the front surface of the root to the rear surface of the root; and a minimum distance from the central plane to the first concave portion is between 5% and 15% a distance from a base of the turbine blade to a tip of the turbine blade.

12. The turbine blade of claim 1, wherein:

a central plane is positioned an equal distance from a first distal edge of the root and a second distal edge of the root;

the central plane extends from the front surface of the root to the rear surface of the root; and a maximum distance from the central plane to the first concave portion is between 15% and 25% a distance from a base of the turbine blade to a tip of the turbine blade.

13. The turbine blade of claim 1, wherein:

a central plane is positioned an equal distance from a first distal edge of the root and a second distal edge of the root;

the central plane extends from the front surface of the root to the rear surface of the root; and a minimum distance from the central plane to the second concave portion is between 5% and 15% a distance from a base of the turbine blade to a tip of the turbine blade.

* * * * *